US010876535B2

(12) United States Patent
Nagao

(10) Patent No.: US 10,876,535 B2
(45) Date of Patent: Dec. 29, 2020

(54) COMPRESSOR

(71) Applicant: MITSUBISHI HEAVY INDUSTRIES COMPRESSOR CORPORATION, Tokyo (JP)

(72) Inventor: Hideki Nagao, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 62 days.

(21) Appl. No.: 16/122,078

(22) Filed: Sep. 5, 2018

(65) Prior Publication Data

US 2019/0085850 A1 Mar. 21, 2019

(30) Foreign Application Priority Data

Sep. 15, 2017 (JP) ..... 2017-177847

(51) Int. Cl.

| | |
|---|---|
| ***F04D 17/12*** | (2006.01) |
| ***F04D 29/28*** | (2006.01) |
| ***F04D 29/08*** | (2006.01) |
| ***F04D 29/051*** | (2006.01) |
| *F04D 29/58* | (2006.01) |

(52) U.S. Cl.

CPC ..... *F04D 17/122* (2013.01); *F04D 29/0516* (2013.01); *F04D 29/083* (2013.01); *F04D 29/284* (2013.01); *F04D 29/051* (2013.01); *F04D 29/584* (2013.01)

(58) Field of Classification Search

CPC .. F04D 17/122; F04D 29/051; F04D 29/0516; F04D 29/083; F04D 29/284; F04D 29/584

See application file for complete search history.

(56) References Cited

U.S. PATENT DOCUMENTS 3,410,616 A * 11/1968 Dee ..... F16C 32/0696 384/107
3,663,117 A * 5/1972 Warren ..... B01F 5/16 415/116
4,385,768 A 5/1983 Swearingen
(Continued)

FOREIGN PATENT DOCUMENTS

| | | | |
|---|---|---|---|
| EP | 0518027 | A1 | 12/1992 |
| JP | 4534142 | B2 | 9/2010 |
| WO | 2016-160414 | A1 | 10/2016 |

*Primary Examiner* — J. Todd Newton
*Assistant Examiner* — Andrew J Marien
(74) *Attorney, Agent, or Firm* — Osha Bergman Watanabe & Burton LLP

(57) ABSTRACT

A compressor includes a thrust force adjusting part which is configured to adjusts a thrust force between a back surface of a disc part in an impeller and a casing. The thrust force adjusting part includes an outer sealing part which seals a gap between the back surface and the casing, an inner sealing part which seals the gap at a position away inward in a radial direction, and a throttle formation part which has a throttle part in which the gap in an axial direction is formed to be narrowed inward in the radial direction. An outer space sandwiched by the outer sealing part and the inner sealing part and an inner space sandwiched by the inner sealing part and the throttle part are formed the gap. The width of the throttle part is narrower than the width of the inner space.

8 Claims, 4 Drawing Sheets

(56) References Cited

U.S. PATENT DOCUMENTS

| | | | | |
|---|---|---|---|---|
| 4,472,107 | A * | 9/1984 | Chang | F04D 29/162 415/104 |
| 4,997,340 | A * | 3/1991 | Zinsmeyer | F04D 29/0516 415/105 |
| 5,297,928 | A * | 3/1994 | Imakiire | F04D 29/5846 415/112 |
| 5,358,378 | A * | 10/1994 | Holscher | F01D 3/04 415/104 |
| 6,190,123 | B1 * | 2/2001 | Wunderwald | F02M 39/00 415/168.1 |
| 6,193,462 | B1 * | 2/2001 | Kubota | F04D 29/2266 415/104 |
| 7,252,474 | B2 * | 8/2007 | Belokon | F01D 3/04 415/1 |
| 9,133,725 | B2 * | 9/2015 | Wiebe | F04D 29/083 |
| 9,951,786 | B2 * | 4/2018 | Elebiary | F04D 29/2266 |
| 2005/0058533 | A1 | 3/2005 | Belokon et al. | |
| 2017/0002825 | A1 * | 1/2017 | Sorokes | F04D 17/10 |

* cited by examiner

COMPRESSOR

CROSS-REFERENCE TO RELATED APPLICATION

Priority is claimed on Japanese Patent Application No. 2017-177847, filed Sep. 15, 2017, the content of which is incorporated herein by reference.

BACKGROUND

Field

The present disclosure relates to a compressor.

Description of Related Art

Generally, a centrifugal compressor includes an impeller provided on a rotary shaft and a casing that defines a flow path between the casing and the impeller by covering the impeller from the outside. In a centrifugal compressor, a fluid supplied from the outside via a flow path formed in the casing is compressed through the rotation of the impeller.

In a centrifugal compressor, a thrust force is generated in the axial directions of the rotary shafts with respect to the impeller and the rotary shaft due to the pressure of the fluid. To be specific, the pressure of the fluid before compression acts on the inner region of the impeller in a radial direction in which an inflow port is formed. Furthermore, in the outer region of the impeller in the radial direction, some of the fluid flowing out from an outflow port in the flow path formed in the impeller flows toward both surfaces of the impeller in the axial direction. Thus, the high pressure of the fluid after compression acts on both surfaces of the impeller in the axial direction in the outer region of the impeller in the radial direction.

As described above, thrust forces in a first direction and a second direction facing opposite to each other in the axial direction act on the impeller due to the pressure of the compressed fluid. The thrust forces in the first direction and the second direction cancel each other out. As a result, a thrust force corresponding to the difference between the thrust forces in the first direction and the second direction actually act on the impeller and the rotary shaft. In order to support the rotary shaft that moves due to such a thrust force, a separate apparatus such as a thrust bearing is provided in a rotary machine such as a centrifugal compressor.

The compressor described in Patent Document 1 has a structure in which a rotary shaft that moves due to a thrust force is supported without using a thrust bearing. To be specific, in this compressor, a balance chamber is formed in a housing which accommodates a rotary shaft and an impeller. Furthermore, a disc-shaped balance piston disposed in the balance chamber is integrally formed with the rotary shaft. Moreover, when the vicinity of the balance piston is sealed with a plurality of seal members, a plurality of spaces are formed in the vicinity of the balance piston. A first labyrinth seal which seals a gap between an outer circumferential surface of the balance piston and an inner circumferential surface of the balance chamber and a second labyrinth seal which seals a gap between an outer circumferential surface of the rotary shaft and the housing are provided as the seal members. A first space facing a high-pressure-side surface of the balance piston upstream from the first labyrinth seal and a second space facing a low-pressure-side surface of the balance piston between the first labyrinth seal and the second labyrinth seal are formed as the spaces formed in the vicinity of the balance piston. In addition, a throttle part is formed between an end surface of the rotary shaft and a distal end of a tongue part extending from the housing toward the end surface of the rotary shaft. Moreover, a third space is formed by the second labyrinth seal and the throttle part at a position away from the low-pressure-side surface of the balance piston compared with the second space.

In the compressor described in Patent Document 1, when a gap in the throttle part is narrowed due to the movement of the rotary shaft, an amount of leakage from the balance chamber is reduced. As a result, the pressures in the second space and the third space formed on the low-pressure-side surface side of the balance piston increase and thus the balance piston is pushed back in a direction in which the gap (clearance) in the throttle part is widened. On the other hand, when the gap in the throttle part is widened due to the movement of the rotary shaft, the amount of leakage from the balance chamber increases. As a result, the pressures in the second space and the third space formed on the low-pressure-side surface side of the balance piston decrease and the balance piston is pushed back in the direction in which the gap (clearance) in the throttle part is narrowed. That is, the balance of the thrust force is adjusted without requiring an apparatus or the like such as the thrust bearing.

PATENT DOCUMENT

[Patent Document 1] Japanese Patent No. 4534142

SUMMARY

However, in the structure in Patent Document 1, it is necessary to provide a disc-shaped balance piston in the rotary shaft. As a result, the length of the rotary shaft increases as in a case in which a separate member such as a thrust bearing is provided. When the length of the rotary shaft increases, adverse effects, such as shaft vibration, and the size and the weight of the compressor are likely to increase. Therefore, it is desirable to balance the thrust force while reducing the length of the rotary shaft.

The present disclosure provides a compressor capable of balancing a thrust force generated in a rotary shaft while reducing the length of the rotary shaft.

A compressor according to a first aspect of the present disclosure includes: a rotary shaft which is configured to rotate about an axis; impellers which have disc parts rotating together with the rotary shaft; a casing which covers the rotary shaft and the impellers; and a thrust force adjusting part which are configured to adjust a thrust force in an axial direction in which the axis extends between a back surface of the disc part facing one side in the axial direction and the casing, wherein the thrust force adjusting part includes: an outer sealing part which seals a gap between the back surface and the casing; an inner sealing part which is disposed at a position away from the outer sealing part inward in a radial direction centered on the axis and seals a gap between the back surface and the casing; and a throttle formation part which has a throttle part in which the gap between the back surface and the casing in the axial direction is narrowed and formed at a position away from the inner sealing part inward in the radial direction, an outer space sandwiched by the outer sealing part and the inner sealing part and an inner space sandwiched by the inner sealing part and the throttle part are formed in the gap between the back surface and the casing, and the width of the throttle part in the axial direction is narrower than the width of the inner space in the axial direction.

With such a constitution, some of the working fluid compressed by the impellers flows into the outer space via the outer sealing part. The working fluid flowing into the outer space flows into the inner space via the inner sealing part. In addition, the working fluid flowing into the inner space flows to the throttle part. When the width of the throttle part in the axial direction is narrower than the width of the inner space in the axial direction, the working fluid flows out from the inner space while being decompressed when passing through the throttle part. In this state, when the impellers move in the axial direction together with the rotary shaft by receiving the thrust force and thus the gap in the throttle part is narrowed, an amount of leakage from the inner space decreases and the pressures in the outer space and the inner space increase. As a result, the impellers are pushed back in the direction in which the gap in the throttle part is widened. On the other hand, when the gap in the throttle part is widened due to the movement of the impellers, the amount of leakage from the inner space increases and the pressures in the outer space and the inner space decrease. As a result, the impellers are pushed back in the direction in which the gap in the throttle part is narrowed. In this way, when the impellers move, it is possible to automatically return the rotary shaft to its original position even when a thrust force acting on the rotary shaft varies and the rotary shaft moves in the axial direction.

Also, in the compressor according to a second aspect of the present disclosure, in the first aspect, the back surface has an inclined surface inclined with respect to the axial direction may be provided in a region facing at least one of the outer space and the inner space.

With such a constitution, when the inclined surface inclined with respect to the axial direction is provided, an area of a region receiving a force in the axial direction increases. Thus, back surfaces of the impellers can receive a large thrust force.

In the compressor according to a third aspect of the present disclosure, in the first or second aspect, the impellers may have convex parts which protrude from the back surface and are integrally formed with the disc part, and at least one of the outer sealing part and the inner sealing part may seal a gap in the radial direction between seal surfaces of the convex parts formed parallel to an outer surface of the rotary shaft and the casing.

With such a constitution, when the seal surface is formed parallel to the outer surface of the rotary shaft, sealing is secured while the movement of the impellers in the axial direction with respect to the outer sealing part and the inner sealing part is allowed. Therefore, it is possible to prevent impairing of sealing even when the movement or thermal expansion of the rotary shaft in the axial direction is generated and thus the position of the seal surface in the axial direction deviates.

In the compressor according to a fourth aspect of the present disclosure, in any one of the first to third aspects, the compressor may further include: a motor which is configured to output a rotational driving force to the rotary shaft; and a motor cooler which is configured to supply a gas flowing out from the inner space via the throttle part to the motor.

With such a constitution, when a gas flowing out from the throttle part is supplied to the motor, it is possible to cool the motor using the gas leaking from the throttle part.

In the compressor according to a fifth aspect of the present disclosure, in any one of the first to fourth aspects, a first impeller and a second impeller which is disposed to face a side opposite to the first impeller in the axial direction and is configured to compress a working fluid compressed using the first impeller may be provided as the impellers, and the thrust force adjusting parts may be provided on the first impeller and the second impeller.

With such a constitution, the position of the rotary shaft is adjusted from both sides in the axial direction. Therefore, it is possible to automatically and rapidly return the rotary shaft to its original position even when the thrust force acting on the rotary shaft varies and thus the rotary shaft moves in the axial direction.

In the compressor according to a sixth aspect of the present disclosure, in any one of the first to fifth aspects, the compressor may further include: an external gas introduction part through which a gas for increasing a pressure in the outer space is introduced from the outside into the outer space.

With such a constitution, it is possible to increase the pressures in the outer space and the inner space even when the working fluid is not yet compressed and a pressure in the outer space cannot be increased using the working fluid like when the compressor is started. Therefore, it is possible to balance a thrust force using the impeller even when the rotary shaft moves in a state in which a pressure of the working fluid is not high.

According to the present disclosure, it is possible to balance a thrust force generated in a rotary shaft while reducing the length of the rotary shaft.

DETAILED DESCRIPTION

First Embodiment

A first embodiment according to the present disclosure will be described below with reference to FIGS. 1 and 2.

Figure 1:
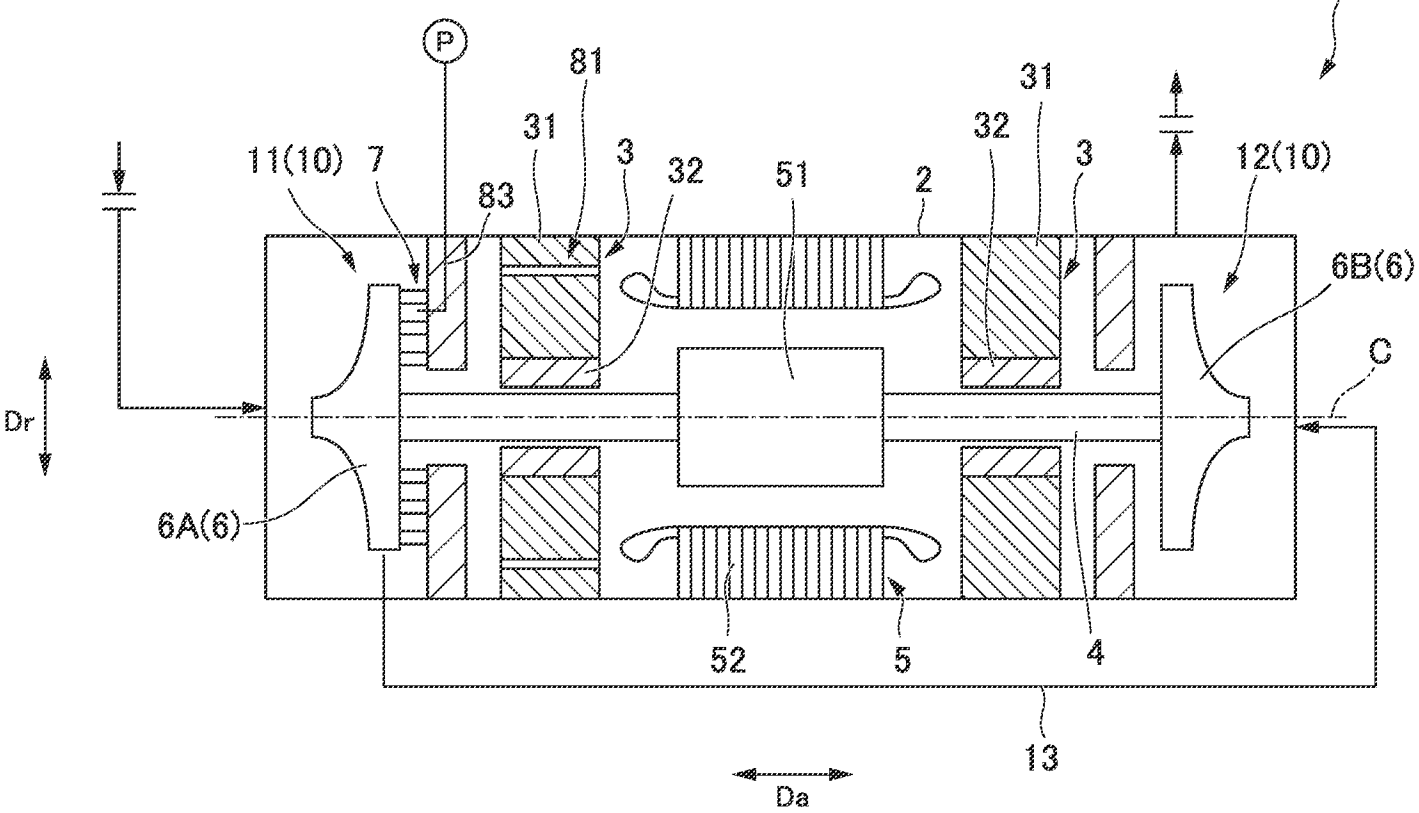
FIG. 1 is a schematic diagram showing a compressor according to a first embodiment of the present disclosure.
Figure 2:
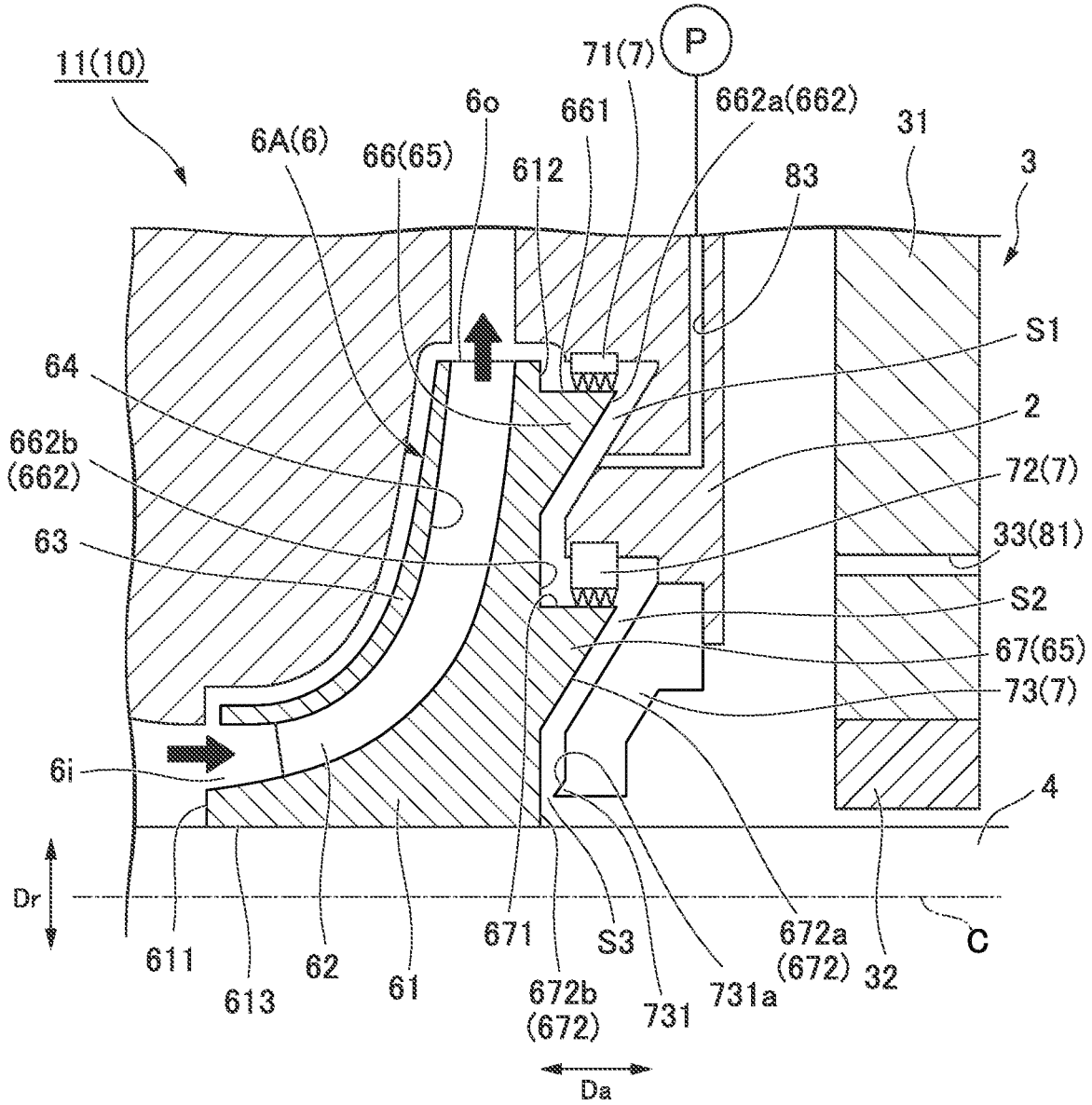
FIG. 2 is a cross-sectional view of a main part showing a constitution of the vicinity of a first impeller provided in a compressor according to the first embodiment of the present disclosure.

As shown in FIG. 1, a compressor 1 according to this embodiment is a motor-integrated compressor including a plurality of impellers 6. The compressor 1 includes a casing 2, journal bearings 3, a rotary shaft 4, a motor 5, the impellers 6, a thrust force adjusting part 7, a motor cooler 81, and an external gas introduction part 83. The compressor 1 according to this embodiment constitutes a facility such as a plant together with upstream and downstream processes from the compressor 1. The compressor 1 includes a pair of compression parts 10 disposed at both ends thereof. The pair of compression parts 10 are a first compression part 11 at a first stage and a second compression part 12 at a second stage. That is, the compressor 1 is configured as a single-shaft two-stage compressor.

In such a compressor 1, a working fluid (process gas) compressed in the first compression part 11 at the first stage flows into the second compression part 12 at the second stage via a pressurizing gas line 13. In the process in which the working fluid flows through the second compression part 12, the working fluid is further compressed and becomes a high pressure working fluid.

The casing 2 forms an outer shell of the compressor 1. The casing 2 covers the journal bearings 3, the rotary shaft 4, the motor 5, and the impellers 6.

The pair of journal bearings 3 are provided in the casing 2 at intervals in an axial direction Da in which an axis C of the rotary shaft 4 extending in a horizontal direction extends. The journal bearings 3 are held in the casing 2. The journal bearings 3 in this embodiment are gas bearings to which a gas is supplied. Bleed air from the working fluid pressurized by the first compression part 11 is supplied to the journal bearings 3 to apply a dynamic pressure and an external gas or bleed air is supplied to the journal bearings 3 to apply a static pressure. The journal bearings 3 include a plurality of strip-shaped pads 32 and a bearing housing 31 configured to hold the pads 32. The pads 32 are curved along an outer surface of the rotary shaft 4. The bearing housing 31 is integrally formed with the casing 2 to protrude from an inner circumferential surface of the casing 2 toward an outer surface of the rotary shaft 4.

The journal bearings 3 can lift the rotary shaft 4 against its own weight when a dynamic pressure is generated in a gas entering between the rotating rotary shaft 4 and the pads 32 and support the rotary shaft 4 in a state in which the rotary shaft 4 is not in contact with the pads 32. However, a dynamic pressure depends on the number of rotations (rotational speed) of the rotary shaft 4. Thus, the working fluid is sufficiently supplied between inner circumferential surfaces of the pads 32 and the outer surface of the rotary shaft 4 to reliably support the rotary shaft 4 even at the time of the low number of rotations and a pressure (static pressure) of this gas is used to help the rotary shaft 4 levitate.

The rotary shaft 4 is rotatable about the axis C. The rotary shaft 4 is rotatably supported by the pair of journal bearings 3 around the axis C. Both end portions of the rotary shaft 4 protrude further toward outsides in the axial direction Da than the pair of journal bearings 3.

The motor 5 is disposed between the first compression part 11 and the second compression part 12. The motor 5 in this embodiment is disposed between the pair of journal bearings 3. The motor 5 includes a motor rotor 51 fixed to be integrally formed with the rotary shaft 4 and a stator 52 configured to cover the motor rotor 51. The stator 52 is fixed to the casing 2. When electricity is supplied to a coil provided on the stator 52, the motor rotor 51 rotates with respect to the stator 52. Thus, the motor 5 outputs a rotational driving force to the rotary shaft 4 and rotates the entire rotary shaft 4 together with the first compression part 11 and the second compression part 12.

The impellers 6 rotate integrally with the rotary shaft 4. The impellers 6 are fixed to the rotary shaft 4 at positions spaced apart from the journal bearings 3 in the axial direction Da. The impellers 6 in this embodiment are fixed to the rotary shaft 4 further outward in the axial direction Da than the pair of journal bearings 3. To be specific, the impellers 6 are provided at both end portions of the rotary shaft 4. The compressor 1 in this embodiment includes two impellers, i.e., a first impeller 6A provided on the first compression part 11 and a second impeller 6B provided on the second compression part 12 as the impellers 6. The second impeller 6B is disposed opposite to the first impeller 6A in the axial direction Da. The second impeller 6B compresses a working fluid compressed by the first impeller 6A. As shown in FIG. 2, in this embodiment, each of the impellers 6 is a so-called closed impeller which includes a disc part 61, blade parts 62, and a cover part 63.

The disc part 61 has a disc shape. For example, the disc part 61 in the first impeller 6A has an outer diameter which gradually decreases from a back surface 612 facing one side (first side) in the axial direction Da toward a front surface 611 facing the other side (second side) in the axial direction Da. That is, the disc part 61 has a substantial umbrella shape as a whole.

Here, the one side in the axial direction Da is a side on which the disc part 61 is disposed with respect to the cover part 63 in the axial direction Da. Therefore, in the first impeller 6A in this embodiment, one side in the axial direction Da is the second compression part 12 side in the axial direction Da which is a side on which the second compression part 12 is disposed with respect to the motor 5 in FIG. 1. On the other hand, in the second impeller 6B in this embodiment, one side in the axial direction Da is the first compression part 11 side in the axial direction Da which is a side on which the first compression part 11 is disposed with respect to the motor 5.

Also, the other side in the axial direction Da is a side on which the cover part 63 is disposed with respect to the disc part 61 in the axial direction Da. Therefore, in the first impeller 6A in this embodiment, the other side in the axial direction Da is the first compression part 11 side in the axial direction Da. On the other hand, in the second impeller 6B in this embodiment, the other side in the axial direction Da is the second compression part 12 side in the axial direction Da.

That is, in the disc part 61 of the second impeller 6B in this embodiment, the back surface 612 faces the first compression part 11 side in the axial direction Da. The disc part 61 in the second impeller 6B has an outer diameter which gradually decreases from the first compression part 11 side in the axial direction Da toward the second compression part 12 side in the axial direction Da.

Also, the disc part 61 has a substantial disc shape when viewed from the axial direction Da. The plurality of blade parts 62 extend from the front surface 611 of the disc part 61 in the axial direction Da at intervals in a circumferential direction thereof. As shown in FIG. 2, a through hole 613 passing through the disc part 61 in the axial direction Da is formed inside the disc part 61 in a radial direction Dr centered on the axis C. The impellers 6 are fixed to the rotary shaft 4 when the rotary shaft 4 is inserted into the through hole 613 and fitted into the through hole 613 through shrinkage-fitting (not shown) or a key.

The cover part 63 is formed to cover the plurality of blade parts 62. The cover part 63 has a disc shape. The cover part 63 is formed as a convex surface in which a side thereof facing the disc part 61 faces the disc part 61 from a certain distance from the disc part 61.

In each of the impellers 6, an impeller flow path 64 is formed between the disc part 61 and the cover part 63. The impeller flow path 64 has an inflow port **6*i* which is opened in the axial direction Da inside in the radial direction Dr on the front surface 611 side of the disc part 61 and an outflow port 6*o* which is opened outward in the radial direction Dr of the impeller 6**.

Also, in this embodiment, only the first impeller 6A of the first impeller 6A and the second impeller 6B has convex parts 65 which protrude from the back surface 612 and are integrally formed with the disc part 61. The first impeller 6A in this embodiment has an outer convex part 66 and an inner convex part 67 as the convex parts 65.

The outer convex part 66 protrudes in the axial direction Da from the back surface 612. The outer convex part 66 in this embodiment protrudes in an annular shape from the back surface 612 of the disc part 61 to surround the through hole 613 in the disc part 61. The outer convex part 66 has an outer sealing surface 661 and an outer pressure receiving surface 662.

The outer sealing surface 661 is formed parallel to the outer surface of the rotary shaft 4. The outer sealing surface 661 is a smooth surface which faces the outside of the outer convex part 66 in the radial direction Dr. In this embodiment, an amount of protrusion of the outer convex part 66 from the back surface 612 is determined in accordance with the width of the outer sealing surface 661 in the axial direction Da. The outer sealing surface 661 is formed at a position that is a predetermined distance from the outer surface of the rotary shaft 4. To be specific, the predetermined distance in this embodiment is a value set in advance for each compressor 1. The predetermined distance is determined in accordance with a magnitude of a force received by the outer pressure receiving surface 662 to balance a thrust force acting on the rotary shaft 4.

The outer pressure receiving surface 662 is a surface which faces a direction including the axial direction Da of the outer convex part 66. That is, the outer pressure receiving surface 662 is a surface which receives a force acting in the axial direction Da. Here, the direction including the axial direction Da is a direction that intersects the axis C excluding a direction orthogonal to the axial direction Da and also includes a direction inclined with respect to the axis C or a direction parallel to the axis C. It is desirable that the outer pressure receiving surface 662 be formed to have as large an area as possible. The outer pressure receiving surface 662 has an outer inclined pressure receiving surface 662*a* and an outer vertical pressure receiving surface 662*b*.

The outer inclined pressure receiving surface 662*a* is an inclined surface inclined with respect to the axis C. The outer inclined pressure receiving surface 662*a* in this embodiment faces one side in the axial direction Da and inward in the radial direction Dr. That is, the outer inclined pressure receiving surface 662*a* is inclined to face the second compression part 12 side in the axial direction Da and the outer surface side of the rotary shaft 4. The outer inclined pressure receiving surface 662*a* extends from an end portion of the outer sealing surface 661 in the axial direction Da toward the outer vertical pressure receiving surface 662*b*.

The outer vertical pressure receiving surface 662*b* is a surface which vertically extends from an inner end portion of the outer inclined pressure receiving surface 662*a* in the radial direction Dr inward in the radial direction Dr. The outer vertical pressure receiving surface 662*b* is a surface which is orthogonal to the outer surface of the rotary shaft 4 and faces one side in the axial direction Da. The outer vertical pressure receiving surface 662*b* in this embodiment faces the second compression part 12 side in the axial direction Da like the back surface 612.

The inner convex part 67 protrudes in the axial direction Da from the back surface 612. The inner convex part 67 is provided further inward in the radial direction Dr than the outer convex part 66. The inner convex part 67 in this embodiment protrudes in an annular shape from the back surface 612 of the disc part 61 to surround the through hole 613 in the disc part 61. The inner convex part 67 has an inner sealing surface 671 and an inner pressure receiving surface 672.

The inner sealing surface 671 is formed parallel to the outer surface of the rotary shaft 4. The inner sealing surface 671 is a smooth surface which faces the outside of the inner convex part 67 in the radial direction Dr. The inner sealing surface 671 is further inward in the radial direction Dr than the outer sealing surface 661. The inner sealing surface 671 in this embodiment is connected to an inner end portion of the outer vertical pressure receiving surface 662*b* in the radial direction Dr. In this embodiment, an amount of protrusion of the inner convex part 67 from the outer vertical pressure receiving surface 662*b* is determined in accordance with the width of the inner sealing surface 671 in the axial direction Da. The inner sealing surface 671 is formed at a position which is a predetermined distance from the outer surface of the rotary shaft 4. To be specific, the predetermined distance in this embodiment is a value set in advance for each compressor 1. The predetermined distance is determined in accordance with a magnitude of a force received by the inner pressure receiving surface 672 to balance a thrust force acting on the rotary shaft 4.

The inner pressure receiving surface 672 is a surface which faces a direction including the axial direction Da of the inner convex part 67. That is, the inner pressure receiving surface 672 is a surface which receives a force acting in the axial direction Da. It is desirable that the inner pressure receiving surface 672 be formed to have as large an area as possible. The inner pressure receiving surface 672 has an inner inclined pressure receiving surface 672*a* and an inner vertical pressure receiving surface 672*b*.

The inner inclined pressure receiving surface 672*a* is an inclined surface in which the inner inclined pressure receiving surface 672*a* is inclined with respect to the axis C. The inner inclined pressure receiving surface 672*a* in this embodiment faces one side in the axial direction Da and inward in the radial direction Dr. The inner inclined pressure receiving surface 672*a* extends from an end portion of the inner sealing surface 671 in the axial direction Da toward the inner vertical pressure receiving surface 672*b*.

The inner vertical pressure receiving surface 672*b* is a surface which vertically extends from an inner end portion of the inner inclined pressure receiving surface 672*a* in the radial direction Dr to an end portion of the through hole 613 inward in the radial direction Dr. That is, the inner vertical pressure receiving surface 672*b* is a surface which is orthogonal to the outer surface of the rotary shaft 4 and faces one side in the axial direction Da. A position of the inner vertical pressure receiving surface 672*b* in an axial direction is formed at the same position as the outer vertical pressure receiving surface 662*b*. The inner vertical pressure receiving surface 672*b* in this embodiment faces the second compression part 12 side in the axial direction Da like the back surface 612.

The thrust force adjusting part 7 adjusts a thrust force in the axial direction Da between the back surface 612 of the disc part 61 and the casing 2. The thrust force adjusting part 7 in this embodiment is provided on the first impeller 6A side. The thrust force adjusting part 7 includes an outer sealing part 71, an inner sealing part 72, and a throttle formation part 73.

The outer sealing part 71 seals a gap between the back surface 612 and the casing 2. The outer sealing part 71 in this embodiment seals a gap between the outer sealing surface 661 and the casing 2 in the radial direction Dr. The outer sealing part 71 is fixed to the casing 2. The outer sealing part 71 is a labyrinth seal in which a minute gap is formed between the outer sealing part 71 and the outer sealing surface 661.

The inner sealing part 72 is disposed at a position away from the outer sealing part 71 inward the radial direction Dr. The inner sealing part 72 seals the gap between the back surface 612 and the casing 2. The inner sealing part 72 in this embodiment seals a gap between the inner sealing surface 671 and the casing 2 in the radial direction Dr. The inner sealing part 72 is fixed to the casing 2. The inner sealing part 72 is a labyrinth seal in which a minute gap is formed between the inner sealing part 72 and the inner sealing surface 671.

The throttle formation part 73 forms a throttle part S3 in which a gap between the back surface 612 and the casing 2 in the axial direction Da is narrowed. The throttle formation part 73 is integrally formed with the casing 2 to be opposite to the back surface 612. The throttle formation part 73 has a protrusion part 731 which protrudes toward the back surface 612. The protrusion part 731 has a protrusion part inclined surface 731*a* which is inclined to approach the outer surface of the rotary shaft 4 when approaching the back surface 612. A throttle part S3 is formed between a distal end of the protrusion part 731 and the back surface 612. The throttle part S3 is formed a position away from the inner sealing part 72 inward in the radial direction Dr. The width of the throttle part S3 in the axial direction Da is narrower than the width of an outer space S1 and an inner space S2 in the axial direction Da which will be described later. In other words, the gap between the back surface 612 and the casing 2 is formed to be the narrowest in the throttle part S3. To be specific, the throttle part S3 is formed between the inner vertical pressure receiving surface 672*b* and the distal end of the protrusion part 731. The throttle part S3 is called a so-called "self-regulating throttle" in which a gap with respect to the back surface 612 changes when the first impeller 6A moves.

The outer space S1 is formed between the back surface 612 and the casing 2 using the outer sealing part 71 and the inner sealing part 72. The outer space S1 is a space which is sandwiched between the outer sealing part 71 and the inner sealing part 72 and extends in the radial direction Dr. It is desirable that the width of the outer space S1 in the axial direction Da be formed as small as possible in a range in which the back surface 612 and the casing 2 are not in contact with each other. The outer space S1 in this embodiment is formed to face the outer inclined pressure receiving surface 662*a* and the outer vertical pressure receiving surface 662*b*. A gas such as a working fluid slightly leaking from the vicinity of the outflow port 6*o* of the impellers 6 in the first compression part 11 via the outer sealing part 71 or a gas supplied from the external gas introduction part 83 which will be described later flows into the outer space S1.

The inner space S2 is formed between the back surface 612 and the casing 2 using the inner sealing part 72 and the protrusion part 731. The inner space S2 is a space which is sandwiched by the inner sealing part 72 and the throttle part S3 and extends in the radial direction Dr. In other words, the inner space S2 is formed further inward in the radial direction Dr than the outer space S1. The inner space S2 is a space continuous to the throttle part S3. It is desirable that the width of the inner space S2 in the axial direction Da be formed as small as possible in a range in which the back surface 612 and the casing 2 are not in contact with each other. The inner space S2 is preferably formed with a volume corresponding to the outer space S1. Here, the corresponding volume is a volume that can be regarded as substantially the same volume. The inner space S2 in this embodiment is formed to face the inner inclined pressure receiving surface 672*a* and the inner vertical pressure receiving surface 672*b*. A gas in the outer space S1 leaks slightly from the inner sealing part 72 and flows into the inner space S2.

The motor cooler 81 supplies a coolant to and cools the motor 5. The motor cooler 81 supplies a gas flowing out from the inner space S2 into the casing 2 via the throttle part S3 to the motor 5 as a coolant. The motor cooler 81 in this embodiment has a housing through hole 311 formed in the bearing housing 31. The housing through hole 311 passes through the bearing housing 31 in the axial direction Da. The housing through hole 311 in this embodiment is provided only in the journal bearings 3 on the first compression part 11 side. Thus, the housing through hole 311 communicates a space in the casing 2 into which a gas passing through the throttle part S3 flows from the inner space S2 with a space in the casing 2 in which the motor 5 is disposed.

A gas for increasing a pressure in the outer space S1 is introduced from the outside into the outer space S1 through the external gas introduction part 83. The external gas introduction part 83 is a gas supply line configured to communicate an external gas supply source with the outer space S1. A booster pump provided on the outside is used as a gas supply source and a gas compressed through the external gas introduction part 83 is supplied to the outer space S1. The external gas introduction part 83 is opened to the casing 2 facing the outer space S1 between the outer sealing part 71 and the inner sealing part 72. The external gas introduction part 83 supplies a gas having a pressure close to that of the working fluid compressed during a steady operation.

In the above-described compressor 1, the working fluid to be compressed is introduced into the first compression part 11 and compressed using the first impeller 6A. The working fluid compressed by the first compression part 11 is introduced into the second compression part 12 through the pressurizing gas line 13. The working fluid introduced into the second compression part 12 is further compressed using the second impeller 6B. The working fluid compressed by the second compression part 12 is supplied to a predetermined plant which is a supply destination.

Here, a part of the working fluid compressed using the first impeller 6A flows from the vicinity of the outflow port 6*o* toward the outer sealing part 71. The working fluid flowing to the outer sealing part 71 slightly leaks into the outer space S1 along the outer sealing surface 661. The working fluid leaking into the outer space S1 flows in the outer space S1 toward the inner sealing part 72. The working fluid flowing to the inner sealing part 72 slightly leaks into the inner space S2 along the inner sealing surface 671. The working fluid leaking into the inner space S2 flows in the inner space S2 toward the throttle part S3. When the width of the throttle part S3 in the axial direction Da is narrower than the width of the inner space S2 in the axial direction Da, the working fluid flows out from the inner space S2 while being decompressed when passing through the throttle part S3. The working fluid flowing into the casing 2 via the throttle part S3 flows into a space in the casing 2 in which the motor 5 is disposed through the housing through hole 311. The working fluid flowing into the space in which the motor 5 is disposed cools the motor 5 and then is discharged to the outside of the casing 2 through a discharge port (not shown).

In such a compressor 1, when the working fluid is compressed by the first compression part 11 and the second compression part 12, a thrust force acting in the axial direction Da is generated with respect to the rotary shaft 4 having the impellers 6 fixed thereto via the disc part 61.

For example, when a thrust force from the first compression part 11 side toward the second compression part 12 side in the axial direction Da is generated with respect to the rotary shaft 4 due to this thrust force, the first impeller 6A moves toward the second compression part 12 side in the axial direction Da together with the rotary shaft 4 by receiving this thrust force. As a result, the first impeller 6A moves toward the second compression part 12 side in the axial direction Da and the gap in the throttle part S3 is narrowed. When the gap in the throttle part S3 is narrowed, an amount of leakage of the working fluid from the inner space S2 decreases and the pressures in the outer space S1 and the inner space S2 increase. Thus, the outer inclined pressure receiving surface 662*a* and the outer vertical pressure receiving surface 662*b* which define the outer space SI and a part of the inner inclined pressure receiving surface 672*a* and the inner vertical pressure receiving surface 672*b* which define the inner space S2 is pushed toward the first compression part 11 side in the axial direction Da. As a result, the first impeller 6A is pushed back in a direction in which the gap of the throttle part S3 is widened.

On the other hand, for example, when a thrust force from the second compression part 12 side toward the first compression part 11 side in the axial direction Dai s generated with respect to the rotary shaft 4, the first impeller 6A moves toward the first compression part 11 side in the axial direction Da together with the rotary shaft 4 by receiving this thrust force. As a result, the first impeller 6A moves toward the first compression part 11 side in the axial direction Da and the gap in the throttle part S3 is widened. When the gap in the throttle part S3 is widened, an amount of leakage of the working fluid from the inner space S2 increases and the pressures in the outer space S1 and the inner space S2 decrease. Thus, the outer inclined pressure receiving surface 662*a* and the outer vertical pressure receiving surface 662*b* which define the outer space S1 and a part of the inner inclined pressure receiving surface 672*a* and the inner vertical pressure receiving surface 672*b* which define the inner space S2 is drawn toward the second compression part 12 side in the axial direction Da. As a result, the first impeller 6A is pushed back in a direction in which the gap in the throttle part S3 is narrowed. Therefore, it is possible automatically return the rotary shaft 4 to its original position by moving the first impeller 6A even when a thrust force acting on the rotary shaft 4 varies and the rotary shaft 4 moves in the axial direction Da.

Also, when a thrust force is balanced using the first impeller 6A which is an indispensable constituent element for compressing the working fluid in the compressor 1, it is unnecessary to secure a space having a special structure for a thrust bearing, a balance piston, or the like in the rotary shaft 4. As a result, it is possible to reduce the length of the rotary shaft 4 and to minimize shaft vibration. In addition, when the length of the rotary shaft 4 is reduced, it is possible to reduce a weight and size of the compressor 1.

In this way, it is possible to balance a thrust force using the first impeller 6A without providing a special structure in the rotary shaft 4. Therefore, it is possible to balance a thrust force generated in the rotary shaft 4 while reducing the length of the rotary shaft 4.

Also, the outer inclined pressure receiving surface 662*a* which defines the outer space S1 is inclined with respect to the axis C. The inner inclined pressure receiving surface 672*a* which defines the inner space S2 is also inclined with respect to the axis C. For this reason, an area increases compared with when the surfaces of the first impeller 6A which define the outer space S1 and the inner space S2 are formed perpendicular to the axis C. As a result, an area of a region which receives a force in the axial direction Da from the working fluid in the outer space S1 or the inner space S2 increases. Thus, the back surface 612 of the first impeller 6A can receive a large thrust force.

Also, when the movement or thermal expansion of the rotary shaft 4 in the axial direction Da is generated, a position of the first impeller 6A in the axial direction Da with respect to the outer sealing part 71 or the inner sealing part 72 is likely to be deviated. However, when the outer sealing surface 661 and the inner sealing surface 671 are formed parallel to the outer surface of the rotary shaft 4, sealing is secured while allowing the movement of the first impeller 6A in the axial direction Da with respect to the outer sealing part 71 or the inner sealing part 72. For this reason, the outer sealing part 71 and the inner sealing part 72 fixed to the casing 2 are not in contact with the outer sealing surface 661 and the inner sealing surface 671 even when the first impeller 6A moves in the axial direction Da and thus sealing can be stably secured. Therefore, it is possible to prevent impairing of sealing even when the movement or thermal expansion of the rotary shaft 4 in the axial direction Da is generated and thus the position of the outer sealing surface 661 or the inner sealing surface 671 in the axial direction Da is deviated.

The working fluid flowing out from the throttle part S3 into the casing 2 via the housing through hole 311 is supplied to a space in the casing 2 in which the motor 5 is disposed. For this reason, the motor 5 is cooled through the working fluid flowing out from the throttle part S3. Thus, it is unnecessary to prepare a separate fluid which bleeds the working fluid compressed by the first compression part 11 as a coolant for cooling the motor 5.

A gas for increasing a pressure in the outer space S1 can be supplied using the external gas introduction part 83. When a gas for increasing a pressure is supplied into the outer space S1, the gas is also supplied into the inner space S2 via the inner sealing part 72. For this reason, it is possible to increase the pressures in the outer space S1 and the inner space S2 even when the working fluid is not yet compressed by the first compression part 11 and a pressure in the outer space S1 cannot be increased using the working fluid like when the compressor 1 is started. Therefore, it is possible to balance a thrust force using the first impeller 6A even when the rotary shaft 4 moves in a state in which a pressure of the working fluid is not high.

Second Embodiment

A second embodiment of the compressor according to the present disclosure will be described below with reference to FIGS. 3 and 4. The second embodiment and the first embodiment differ in that, in a compressor 1A shown in the second embodiment, convex parts are also formed in a second impeller of a second compression part and in that thrust force adjusting parts are also provided on the second compression part side. Therefore, in the description of the second embodiment, constituent elements that are the same as those of the first embodiment will be denoted with the same reference numerals and overlapping description thereof will be omitted.

Figure 3:
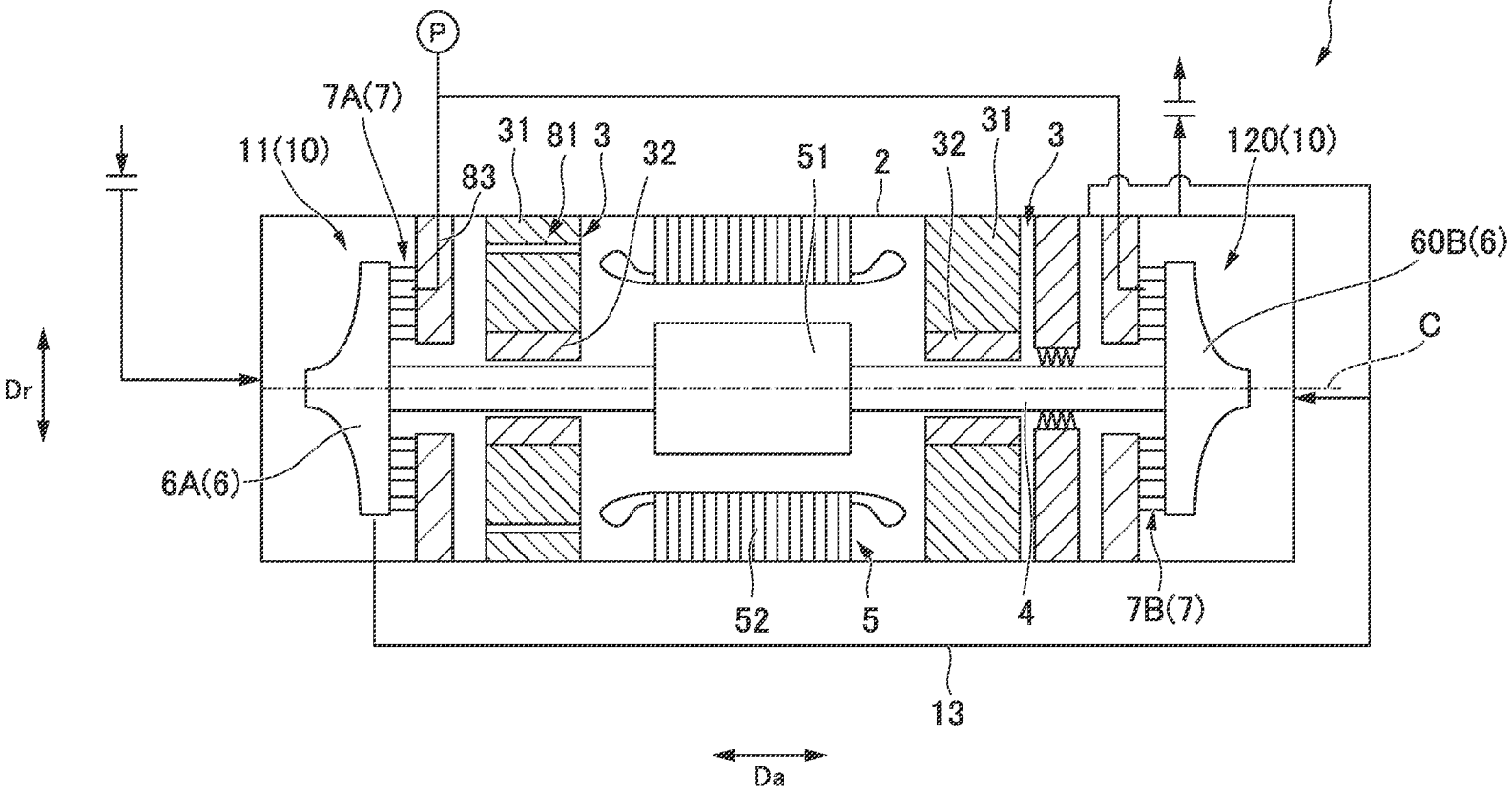
FIG. 3 is a schematic diagram showing a compressor according to a second embodiment of the present disclosure.
Figure 4:
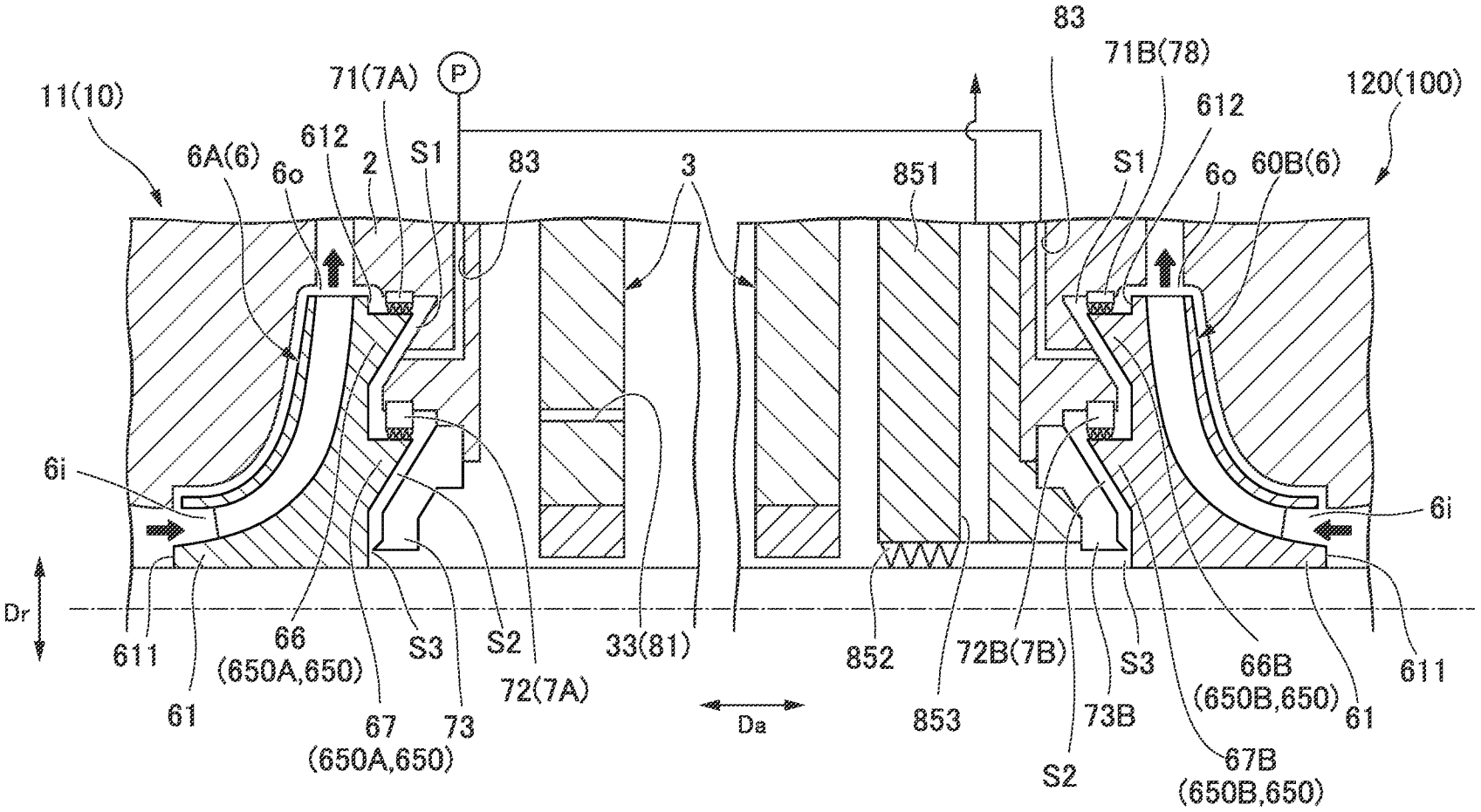
FIG. 4 is a cross-sectional view of a main part showing a constitution of the vicinity of a first impeller and a second impeller provided in the compressor according to the second embodiment of the present disclosure.

As shown in FIG. 3, in the compressor 1A according to the second embodiment, thrust force adjusting parts 70 are provided on both a first compression part 11 and a second compression part 120. To be specific, the compressor 1A has a first thrust force adjusting part 7A provided on the first compression part 11 side and a second thrust force adjusting part 7B on the second compression part 120 side as the thrust force adjusting parts 70. The first thrust force adjusting part 7A has the same constitution as the thrust force adjusting part 7 in the first embodiment. As shown in FIG. 4, the second thrust force adjusting part 7B has an outer sealing part 71B, an inner sealing part 72B, and a throttle formation part 73B.

Correspondingly, in the compressor 1A according to the second embodiment, both a first impeller 6A and a second impeller 60B have convex parts 650 which protrude from a back surface 612 and are integrally formed with a disc part 61. To be specific, the first impeller 6A has a first convex part 650A having the same constitution as the convex parts 65 in the first embodiment. The second impeller 60B has a second convex part 650B. The second convex part 650B has an outer convex part 66B and an inner convex part 67B.

In the first compression part 11 and the second compression part 120, the back surface 612 of the disc part 61 in the first impeller 6A and the back surface 612 of the disc part 61 in the second impeller 60B face each other in opposite directions in the axial direction Da. Therefore, the first thrust force adjusting part 7A and the second thrust force adjusting part 7B have a symmetrical shape to be inverted with imaginary lines orthogonal to the axis C. In other words, the outer sealing part 71B, the inner sealing part 72B, and the throttle formation part 73B in the second thrust force adjusting part 7B have a symmetrical shape with respect to an outer sealing part 71, an inner sealing part 72, and a throttle formation part 73 in the first thrust force adjusting part 7A. Likewise, the first convex part 650A and the second convex part 650B have a symmetrical shape to be inverted with imaginary lines orthogonal to the axis C. Therefore, the outer convex part 66B and the inner convex part 67B in the second convex part 650B have a symmetrical shape with respect to the outer convex part 66 and the inner convex part 67 in the first convex part 650A.

The compressor 1A according to the second embodiment includes a high pressure gas discharge part 85. The high pressure gas discharge part 85 is disposed between a journal bearing 3 on the second compression part 120 side in the axial direction Da and the second impeller 60B. The high pressure gas discharge part 85 discharges a working fluid flowing out from an inner space S2 via a throttle part S3 of the second thrust force adjusting part 7B so that the working fluid does not flow out toward the journal bearing 3 or the motor 5 side. The high pressure gas discharge part 85 includes, as a single body, a discharge part main body 851 fixed to the casing 2 and a labyrinth part 852 which is provided inside the discharge part main body 851 in the radial direction Dr and seals a gap between the discharge part main body 851 and an outer surface of a rotary shaft 4. The discharge part main body 851 has a discharge part through hole 853 therethrough in the radial direction Dr. The discharge part through hole 853 is connected to a pressurizing gas line 13 connected to connected to an inflow port 6*i* of the second impeller 60B. The labyrinth part 852 is provided closer to the first compression part 11 side in the axial direction Da than the discharge part through hole 853.

In the compressor 1A according to the second embodiment, a motor cooler 81 is provided only on the first compression part 11 side as in the first embodiment. Therefore, a housing through hole 311 is not formed in the journal bearing 3 on the second compression part 120 side in the axial direction Da. Thus, the motor cooler 81 does not supply the working fluid compressed by the second compression part 120 to the motor 5 and supplies only the working fluid compressed by the first compression part 11 to the motor 5.

In the compressor 1A according to the above-described second embodiment, a part of the working fluid compressed by the first impeller 6A flows into an outer space S1, the inner space S2, and the throttle part S3 on the first compression part 11 side as described in the first embodiment. In addition, a part of the working fluid compressed by the second impeller 60B flows from the vicinity of an outflow port 6*o* in the second impeller 60B toward the outer sealing part 71B in the second thrust force adjusting part 7B. The working fluid flowing to the outer sealing part 71B slightly leaks into the outer space S1 on the second compression part 120 side along the outer sealing surface 661. The working fluid leaking into the outer space S1 as well flows in the outer space S1 toward the inner sealing part 72B. The working fluid flowing to the inner sealing part 72B slightly leaks into the inner space S2 along the inner sealing surface 671. The working fluid leaking into the inner space S2 flows in the inner space S2 toward the throttle part S3. When the width of the throttle part S3 in the axial direction Da is narrower than the width of the inner space S2 in the axial direction Da, the working fluid flows out from the inner space S2 while being decompressed when passing through the throttle part S3. When the working fluid flowing out via the throttle part S3 is sealed using the labyrinth part 852 in the high pressure gas discharge part 85, the working fluid does not flow into the journal bearing 3 on the second compression part 120 side and flows into the discharge part through hole 853. The working fluid flowing into the discharge part through hole 853 is supplied to the inflow port 6*i* in the second impeller 60B again via the pressurizing gas line 13.

According to such a compressor 1A, when a thrust force acts on the rotary shaft 4, each of the first thrust force adjusting part 7A and the second thrust force adjusting part 7B operates. To be specific, for example, when a thrust force from the first compression part 11 side toward the second compression part 120 side in the axial direction Da is generated with respect to the rotary shaft 4, the first impeller 6A moves toward the second compression part 120 side in the axial direction Da together with the rotary shaft 4. As a result, the first impeller 6A moves toward the second compression part 120 side in the axial direction Da by receiving the thrust force and a gap in the throttle part S3 on the first compression part 11 side is narrowed. On the other hand, when the second impeller 60B also moves toward the second compression part 120 side in the axial direction Da, a gap in the throttle part S3 on the second compression part 120 side is widened. Therefore, in the first compression part 11, the pressures in the outer space S1 and the inner space S2 increase, and in the second compression part 120, the pressures in the outer space S1 and the inner space S2 decrease. Thus, on the first compression part 11 side, the outer pressure receiving surface 662 and the inner pressure receiving surface 672 are pushed toward the first compression part 11 side in the axial direction Da. On the other hand, on the second compression part 120 side, the outer pressure receiving surface 662 and the inner pressure receiving surface 672 are drawn toward the second compression part 120 side in the axial direction Da. As a result, both of the first impeller 6A and the second impeller 60B move toward the first compression part 11 side in the axial direction Da. Thus, a position of the rotary shaft 4 is adjusted from both sides in the axial direction Da. This is the same even when a direction of a thrust force acting on the rotary shaft 4 is reversed (in a direction from the second compression part 120 side toward the first compression part 11 side in the axial direction Da). Therefore, it is possible to automatically and quickly return the rotary shaft 4 to its original position even when the thrust force acting on the rotary shaft 4 varies and the rotary shaft 4 moves in the axial direction Da.

Also, unlike the first embodiment, when a thrust force is balanced from both sides in the axial direction Da, it is possible to stably return the rotary shaft 4 to its original position even when one of the thrust force adjusting parts fails to function properly.

Another Modified Example of Embodiment

Although the embodiments according to the present disclosure have been described in detail above with reference to the drawings, each of the constitutions in each of the embodiments, a combination thereof, and the like are merely examples and additions, omissions, substitutions, and other modifications of a constitution are possible without departing from the gist of the present disclosure. Furthermore, the present disclosure is not limited by the embodiments, and is limited only by the scope of the claims.

It should be noted that the impellers 6 are not limited to a constitution in which two impellers like the compressors 1 and 1A in this embodiment are disposed. For example, one impeller may be provided or a plurality of impellers 6 of three or more stages as in a multistage centrifugal compressor may be provided.

Also, the back surface 612 of the disc part 61 is not limited to a structure having both of the outer inclined pressure receiving surface 662*a* and the inner inclined pressure receiving surface 672*a* as in this embodiment. The back surface 612 of the disc part 61 may have an inclined surface inclined with respect to the axial direction Da in a region facing at least one of the outer space S1 and the inner space S2. Therefore, for example, the back surface 612 of the disc part 61 may have only the outer inclined pressure receiving surface 662*a* or only the inner inclined pressure receiving surface 672*a*.

When the throttle formation part 73 protrudes from the casing 2 toward the back surface 612, the throttle formation part 73 is not limited to the formation of the throttle part S3. The throttle formation part 73 may be adopted as long as the throttle part S3 can be formed therein and may have a protrusion part protruding from the back surface 612 toward the casing 2.

EXPLANATION OF REFERENCES

1, 1A Compressor
10 Compression part
11 First compression part
12, 120 Second compression part
13 Pressurizing gas line
2 Casing
3 Journal bearing
31 Bearing housing
311 Housing through hole
32 Pad
4 Rotary shaft
C Axis
5 Motor
51 Motor rotor
52 Stator
Da Axial direction
Dr Radial direction
6 Impeller
6A First impeller
6B, 60B Second impeller
61 Disc part
611 Front surface
612 Back surface
613 Through hole
62 Blade part
63 Cover part
64 Impeller flow path
6*i* Inflow port
6*o* Outflow port
65, 650 Convex part
66, 66B Outer convex part
661 Outer sealing surface
662 Outer pressure receiving surface
662*a* Outer inclined pressure receiving surface
662*b* Outer vertical pressure receiving surface
67, 67B Inner convex part
671 Inner sealing surface
672 Inner pressure receiving surface
672*a* Inner inclined pressure receiving surface
672*b* Inner vertical pressure receiving surface
7, 70 Thrust force adjusting part
71, 71B Outer sealing part
72, 72B Inner sealing part
73, 73B Throttle formation part
731 Protrusion part
S1 Outer space
S2 Inner space
S3 Throttle part
81 Motor cooler
83 External gas introduction part
7A First thrust force adjusting part
7B Second thrust force adjusting part
650A First convex part
650B Second convex part
85 High pressure gas discharge part
851 Discharge part main body
852 Labyrinth part
853 Discharge part through hole

What is claimed is:

1. A compressor, comprising:

a rotary shaft which is configured to rotate about an axis;

impellers which have a disc part rotating together with the rotary shaft;

a casing which covers the rotary shaft and the impellers; and a thrust force adjusting part which is configured to adjust a thrust force in an axial direction in which the axis extends between a back surface of the disc part facing one side in the axial direction and the casing, wherein the thrust force adjusting part includes:

an outer sealing part which seals a gap between the back surface and the casing;

an inner sealing part which is disposed at a position away from the outer sealing part inward in a radial direction centered on the axis and seals the gap between the back surface and the casing; and a throttle formation part which has a throttle part in which the gap between the back surface and the casing in the axial direction is formed to be narrowed and formed at a position away from the inner sealing part inward in the radial direction, an outer space sandwiched by the outer sealing part and the inner sealing part and an inner space sandwiched by the inner sealing part and the throttle part are formed in the gap between the back surface and the casing, a width of the throttle part in the axial direction is narrower than a width of the inner space in the axial direction, the impellers have two convex parts that protrude from the back surface and are integrally formed with the disc part, the outer sealing part and the inner sealing part each seal a corresponding gap in the radial direction between seal surfaces of the convex parts formed parallel to an outer surface of the rotary shaft and the casing, the throttle formation part has a protrusion part which protrudes toward the back surface from the casing inward the radial direction with respect to the two convex parts, a volume of the inner space is formed to be same as a volume of the outer space, only the two convex parts protrude from the back surface, and the throttle part is formed such that when the gap in the throttle part is narrowed, an amount of leakage from the inner space decreases, and when the gap in the throttle part is widened, the amount of leakage from the inner space increases.

2. The compressor according to claim 1, wherein the back surface has an inclined surface inclined with respect to the axial direction is provided in a region facing at least one of the outer space and the inner space.

3. The compressor according to claim 1, further comprising:

a motor which is configured to output a rotational driving force to the rotary shaft; and a motor cooler which is configured to supply a gas flowing out from the inner space via the throttle part to the motor.

4. The compressor according to claim 1, wherein the impellers include a first impeller and a second impeller which is disposed to face a side opposite to the first impeller in the axial direction and is configured to compress a working fluid compressed using the first impeller, and the thrust force adjusting part is provided on the first impeller and the second impeller.

5. The compressor according to claim 1, further comprising:

an external gas introduction part through which a gas for increasing a pressure in the outer space is introduced from the outside into the outer space.

6. The compressor according to claim 2, further comprising:

a motor which is configured to output a rotational driving force to the rotary shaft; and a motor cooler which is configured to supply a gas flowing out from the inner space via the throttle part to the motor.

7. The compressor according to claim 2, wherein the impellers include a first impeller and a second impeller which is disposed to face a side opposite to the first impeller in the axial direction and is configured to compress a working fluid compressed using the first impeller, and the thrust force adjusting part is provided on the first impeller and the second impeller.

8. The compressor according to claim 3, wherein the impellers include a first impeller and a second impeller which is disposed to face a side opposite to the first impeller in the axial direction and is configured to compress a working fluid compressed using the first impeller, and the thrust force adjusting part is provided on the first impeller and the second impeller.

* * * * *